US006379063B1

(12) United States Patent
Gutierrez et al.

(10) Patent No.: US 6,379,063 B1
(45) Date of Patent: Apr. 30, 2002

(54) PROGRAMMABLE MULTIPLE STAPLE POSITIONING IN POST-PROCESSING OF SHEETS FROM SHEET HANDLING EQUIPMENT

(75) Inventors: Hernan Gutierrez, Jalisco (MX); Laurent A. Regimbal, Eagle, ID (US); Rual Ocampo, Jalisco (MX)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/494,618

(22) Filed: Jan. 31, 2000

(51) Int. Cl.[7] ..... B41J 11/48
(52) U.S. Cl. ..... 400/602; 400/630
(58) Field of Search ..... 400/602, 622, 400/624, 613, 611, 613.1, 625, 630; 270/37, 58.08, 58.09, 58.12, 58.17

(56) References Cited

U.S. PATENT DOCUMENTS

| | | | | | |
|---|---|---|---|---|---|
| 5,150,998 | A | * | 9/1992 | Murakami et al. | 412/14 |
| 5,383,754 | A | * | 1/1995 | Sumida et al. | 412/11 |
| 5,642,876 | A | * | 7/1997 | Ferrara et al. | 270/58.01 |
| 5,772,198 | A | * | 6/1998 | Yamamoto | 270/58.12 |
| 5,797,596 | A | * | 8/1998 | Morigami et al. | 270/58.11 |
| 5,918,871 | A | * | 7/1999 | Saito et al. | 270/58.11 |
| 6,027,270 | A | * | 2/2000 | Greive | 400/625 |

* cited by examiner

*Primary Examiner*—Andrew H. Hirshfeld
*Assistant Examiner*—Darius Cone

(57) ABSTRACT

A discharge tray for a sheet material handling device such as a printer includes multiple stapler mechanisms. The multiple stapler mechanisms are positioned along an edge of a discharge tray so that, by selectively engaging the stapler mechanisms, a desired staple pattern is established according to the nature of an assembled document and according to sheet sizes of the sheet material.

3 Claims, 3 Drawing Sheets

PROGRAMMABLE MULTIPLE STAPLE POSITIONING IN POST-PROCESSING OF SHEETS FROM SHEET HANDLING EQUIPMENT

FIELD OF THE INVENTION

The invention relates to handling of sheet media such as paper. More specifically, the invention relates to positioning of staples in stacked sheets delivered from sheet media handling equipment such as printers.

BACKGROUND OF THE INVENTION

One commonly used method of permanently fixing multiple pages is stapling of the pages. When print jobs are produced by laser printing, photocopying and other short-run processes, it may be desired to staple the pages at different places. By way of example, it is common to select a single staple near a corner of a page or several staples aligned along one edge.

In addition to providing a convenience for the user in eliminating a separate stapling step, sheet stapling also maintains a stack in alignment that makes it easier to keep completed paper handling jobs together and keep multiple copies of print jobs separate.

In providing a stapling capability, it is necessary to provide the sheets in a desired alignment and choose a staple position. While some types of print jobs or other sheet handling jobs are such that stapling would not be possible, it is desired to maximize the percentage of paper handling jobs in which stapling is an option. It is also desired to provide the user with a staple arrangement on a print job or other paper handling job which is more suited to the user's staff needs.

In the prior art, it had been common to provide a staple in one corner of the page. This provides a generally uniform selection of staple position and is acceptable for a large number of print jobs. If the user determines that multiple stapling is desired, this can be accomplished manually. If the alignment of the single staple is suitable, sheet alignment and collation is facilitated even though the user must provide additional stapling.

When paper handling equipment is provided with a stapling capability, not only is a stapler required, but additional page alignment and staple alignment arrangements must be included. In addition, a power supply suitable for operating the stapler and control circuitry must be provided. Therefore, the costs of adding a stapling capability exceeds that of the costs of providing a stapler mechanism.

One desired feature provided on printers is an ability of the printer to render print jobs at remote locations. In such cases, the user may wish to control, not only the formatting for the printed sheets, but also a format for the complete print job. It would be desirable to include, in such remotely rendered print jobs, a staple configuration. Thus, if the user could designate a configuration for stapling, it would be possible to provide a finished document at a remote location.

SUMMARY OF THE INVENTION

In accordance with the present invention, the sheet material handling includes a device which registers sheets in an accumulator module. In order to provide a stapling operation as defined by the user, a plurality of staple positions are established. A distance from the edge of a sheet for each stapled position is defined, and this distance establishes a position that a staple will have on the paper.

According to a further aspect of the invention, a printer is responsive to remote signals in order to perform a print job, including printing a plurality of sheets and assembling the sheets into a document. This enables the printer to render completed, assembled print jobs at remote locations. Such remote locations may include locations on a local area network (LAN) or locations accessible through Internet connections such as those using the TCP/IP protocol. According to the present invention, the user may transmit signals to a remote printer which provide formatting for the printed sheets, as well as a format for the complete print job. Included in the complete print job is a preferred staple configuration, so that according to the present invention it is possible to provide a finished document from a remote location.

In accordance with a further aspect of the invention, a paper handling device such as a printer has a post-processing unit with a stapling capability. The post-processing unit establishes a minimum distance allowed between staples and a minimum distance of a first staple from an edge of the sheets. The staples are then applied in a desired manner according to a desired number of staples and detected sheet size, with the desired number of staples not exceeding the minimum distances.

According to a further embodiment of the invention, a number of staples permitted to be used on a stack of sheets discharged from the sheet material handling machine is established by minimum distances between adjacent staples, and a predetermined minimum distance between an edge of the stack and a first staple. This permits the use of multiple staplers and multiple staple positions in a manner consistent with sheet sizes of various sheets which may be discharged by the sheet material handling equipment. However, in a particular embodiment of the invention, the stapling function is handled by multiple stapler mechanisms, so that the minimum distance between staples coincides with a dimensional restriction of placement of adjacent stapling mechanisms. By establishing the minimum distances, it is possible to provide the post-processing equipment for the sheet material handler with the capability of moving the multiple staplers to different positions, and without unduly limiting the ability of the sheet material handler to process and accept completed print jobs.

DETAILED DESCRIPTION OF THE INVENTION

Figure 1:
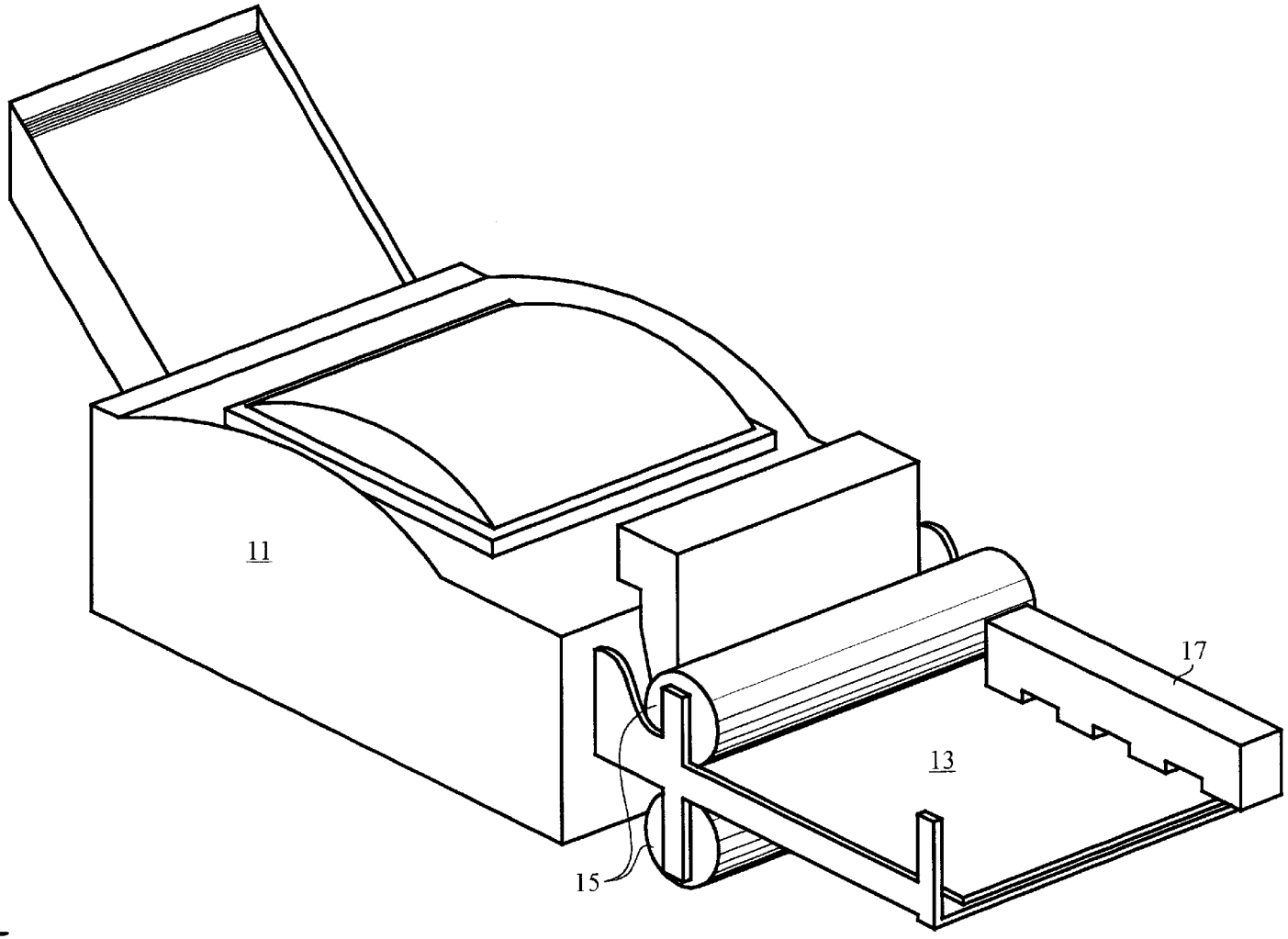
FIG. 1 is an elevated view of a printer having an output tray for registration of sheets, permitting stapling of the sheets.

Referring to FIG. 1, a printer 11 has an output tray 13. Sheets which are output from the printer 11, are discharged, for example by output rollers 15. The discharged sheets are received by the output tray 13 and fall into registration along a fence or edge 15.

Figure 2:
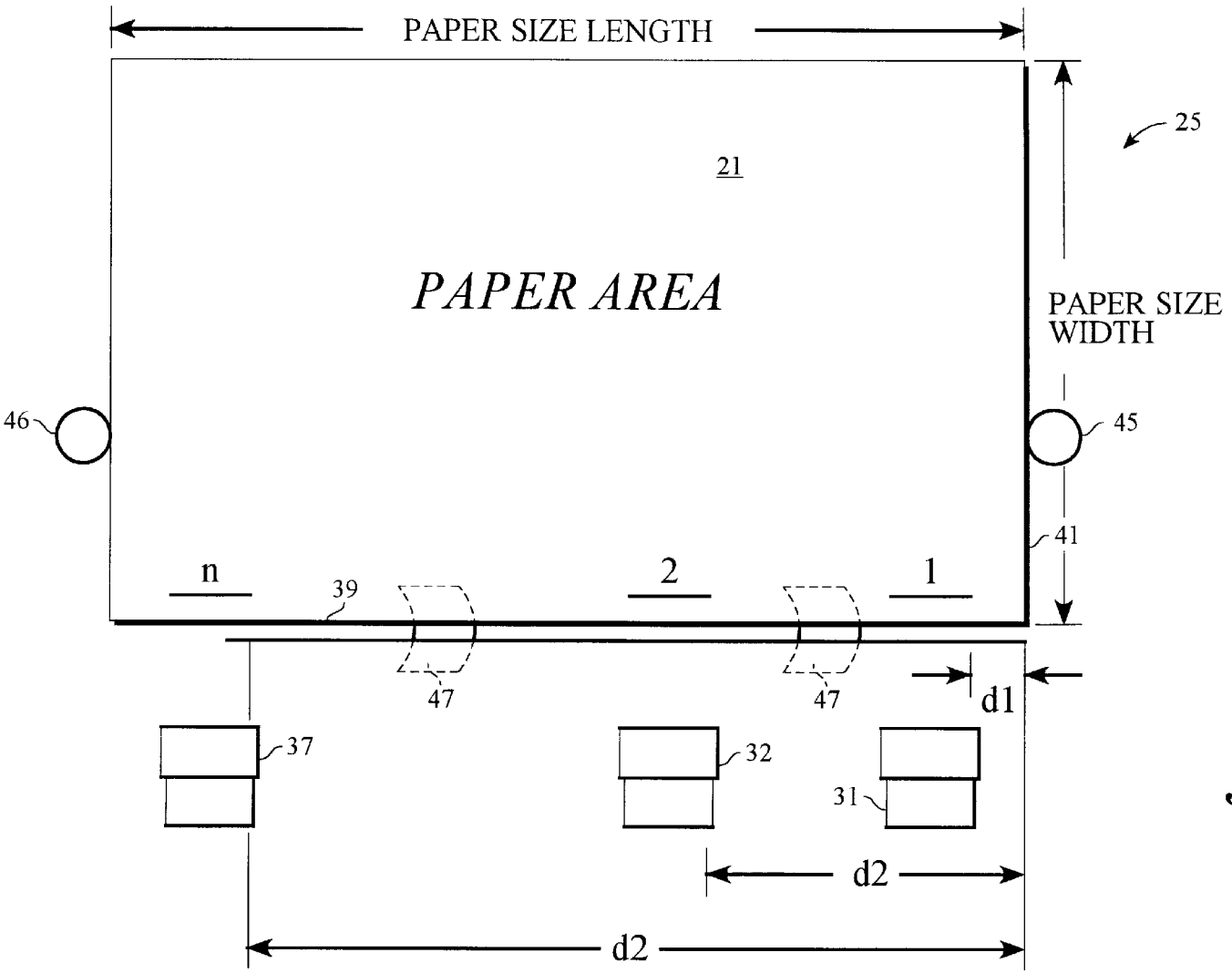
FIG. 2 shows a representation of a stack of sheets in plan view, along with potential staple positions.

FIG. 2 shows a sheet of paper 21, with multiple staple positions 1, 2, . . . n. While a single sheet 21 is shown, the invention is intended for use with multiple sheets in a stack. The multiple sheets are generally aligned so that n plan view, the top sheet is visible. These sheets form a stack 25 which includes sheet 21.

A row of staplers or stapling mechanisms 31, 32, 37 are aligned along a first edge 39 of the stack 25. Thus, the stack 25 can be stapled at multiple positions by the multiple staplers 31, 32, 37. The number of staplers is limited by the spacing requirements between the staplers, and in this example, it can be said that seven staplers are provided. Thus, if the size of the sheet 21 were sufficiently large, it would be possible to include staples at seven staple positions along the edge 39.

Normally, either a single staple (shown at position 1) or up to three staples would be selected, so that the use of a larger number of staplers primarily has the advantage of permitting selection of different stapler positions. In addition, the stack 25 must be aligned in order to accept stapling of any type. Therefore, a requirement for alignment for multiple staplers is essentially accomplished by the alignment for a single stapler used to attach one staple.

Stapler 31 is shown positioned so that its staple is predetermined distance d1 from a starting edge 41 of the stack 25. While it is often possible to place a staple either at the edge of in some cases over the edge of the stack 41, it is determined that providing a minimum distance d1 creates a desired stapling arrangement for the stack 25.

In addition, it is possible to provide the multiple staplers 31, 32, 37 at fixed positions or semi-fixed positions. Therefore, if a suitable initial position for stapler 31 is chosen, stapler 31 can be used for both single staple applications and some multiple staple applications. The reference to "semi-fixed" means that it is possible to move the stapling mechanisms 31, 32, 37 either manually or automatically.

Stapler 32, being adjacent stapler 31 must be positioned so that its starting staple position d2 is at least a minimum distance from the starting staple position d1 of stapler 31. Thus, the distance from edge 41 for stapler 32 is established by d1+w=d2, where w is minimum spacing distance established by the geometry of the staplers 31, 32. It is anticipated that d2 will actually be established at a position that is further from the initial edge 41 than the minimum, and that the initial position will be selected in accordance with a desired staple pattern.

This sequence of placement of sequential stapler mechanisms continues until a position for a last stapler mechanism 37 is selected. In this case, d2 must have a minimum position of d1+w+w . . . +w=d2, wherein the number of "w" terms is established by the number of stapler mechanisms, not including the stapler mechanism 37 whose position is determined. It can be seen that the total number of stapler mechanisms is limited by a maximum permissible width of edge 39 for a particular sheet handling machine. It is also anticipated that a lesser number of stapler mechanisms will be selected, in that it is not likely that an overly large number of staple positions be provided. While it is unlikely that seven staples will be used for most print jobs, the provision of the seven stapler mechanisms makes such binding possible. The multiple stapler positions also permit selection of which stapler mechanisms 31, 32, 37 are to be used for any particular stapler jobs. Thus, if two staples are to be used, two appropriately positioned stapler mechanisms can be engaged.

Figure 3:
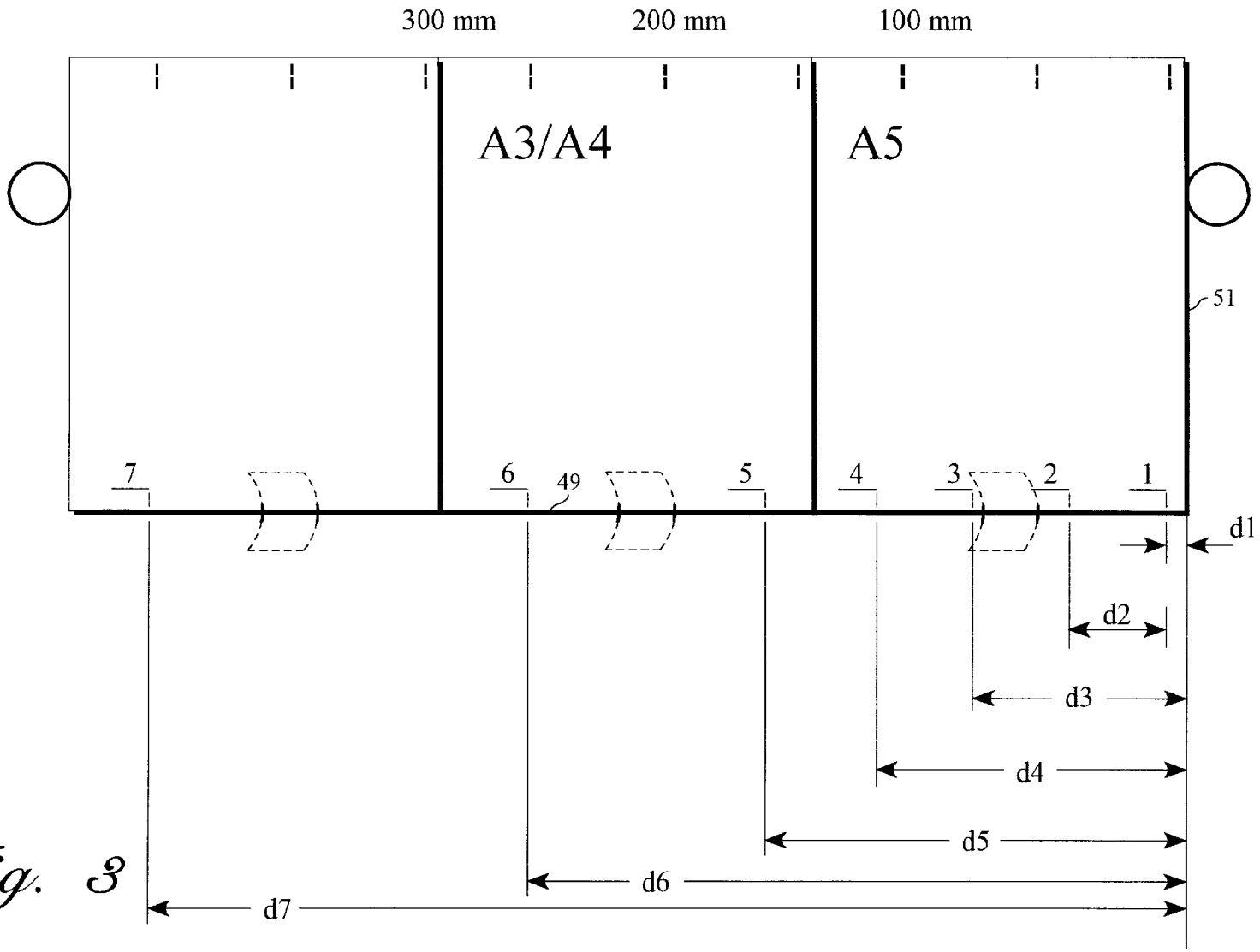
FIG. 3 shows the use of multiple staple positions to accommodate different sizes of sheets discharged from the paper handling equipment.

Referring to FIG. 3, a representation of the profiles of different size sheets is shown. A stapled edge 49 is shown, along with a starting edge 51. Staple positions 1–4 are shown such that an A5 sheet can accept up to four staple positions. In the case of an A3 or A4 sheet, six staple positions are shown. In a typical configuration, it is likely that only two staples, such as staples at positions 1 and 4 would be used for the A5 sheets. Likewise, in the case of an A3 or A4 sheet, three or four staples are likely to be used. The positions of the staples can be selected as desired. If the stapling mechanisms are repositioned, one would have more choices as to desired staple positions on the sheets. In this case, various staple positions can be selected according to a desired staple pattern for a number of sheets. Since multiple stapling mechanisms can be used, it is not necessary that the stapling mechanisms be moved for each stapled print job.

The stapling operation can take place in any convenient manner. For example, if available current from a power supply is limited, multiple staples can be applied sequentially, rather than simultaneously. Since the stapling mechanisms are aligned in a desired position, such sequential stapling would not take an excessive amount of time, and therefore not slow the operation of a sheet material handling machine.

Various modifications can be made by those of ordinary skill in the art with the benefit of this disclosure without departing from the spirit and scope of the invention. For example it is anticipated that the TCP/IP protocol in use for Internet communications at the time of the filing of this patent application will be refined to a future protocol. It is intended that the present invention be used with such a future protocol. Accordingly the reference to an Internet protocol should be read to include TCP/IP and future protocols adapted for similar purposes. Thus, the invention should not be limited by the specific embodiments used to illustrate it but only by the scope of the appended claims.

What is claimed:

1. Sheet material handling equipment comprising:

a primary processing mechanism;

a discharge mechanism receiving sheet material from the primary processing mechanism;

a discharge tray, the discharge tray including an alignment mechanism for establishing an edge alignment for the discharged sheet material;

a plurality of stapler mechanisms, the plurality of stapler mechanisms aligned such that selected ones of the stapler mechanisms can staple sheet material aligned in the discharge tray, thereby establishing a pattern of multiple staples in the discharge tray; and a selector responsive to remote signals for selectively engaging one or more of said plurality of stapler mechanisms in accordance with a desired staple pattern, wherein the selector is responsive to remote signals conforming to an Internet protocol thereby enabling control of post processing of a print job, including said desired staple pattern, through the Internet protocol.

2. A printer assembly capable of remote operation, the printer assembly comprising:

a printer capable of printing sheets of sheet material in response to remote signals;

a discharge mechanism receiving the printed sheet material, the discharge mechanism including a discharge tray and an alignment mechanism for establishing an edge alignment for the received printed sheet material;

a plurality of stapler mechanisms aligned such that selected ones of the stapler mechanisms can staple sheet material aligned in the discharge tray, thereby establishing a pattern of multiple staples in the discharge tray; and a selector responsive to the remote signals for selectively engaging one or more of said plurality of stapler mechanisms in accordance with a desired staple pattern, wherein the selector is responsive to remote signals conforming to an Internet protocol thereby enabling control of post processing of a print job, including said desired staple pattern, through the Internet protocol.

3. Method for post processing of sheet material comprising:

discharging sheet media from a primary sheet material processing mechanism;

establishing an edge alignment for the discharged sheet material;

providing a plurality of stapler mechanisms;

aligning the plurality of stapler mechanisms such that selected ones of the stapler mechanisms can staple sheet material in said edge alignment; and responding to remote signals to selectively engage one or more of said plurality of stapler mechanisms in accordance with a desired staple pattern, wherein responding to remote signals comprises responding to remote signals via an Internet protocol thereby enabling control of post processing of a print job, including said desired staple pattern, through the Internet protocol.

* * * * *